US007065906B2

(12) United States Patent
Jones et al.

(10) Patent No.: US 7,065,906 B2
(45) Date of Patent: Jun. 27, 2006

(54) SHOE CLOSURE SYSTEM

(75) Inventors: Martin John Jones, Wiesendorf (DE); Klaus Hubertus Rolshoven, Scheinfeld (DE)

(73) Assignee: adidas International Marketing B.V. (NL)

( * ) Notice: Subject to any disclaimer, the term of this patent is extended or adjusted under 35 U.S.C. 154(b) by 86 days.

(21) Appl. No.: 10/720,845

(22) Filed: Nov. 24, 2003

(65) Prior Publication Data

US 2004/0134099 A1 Jul. 15, 2004

(30) Foreign Application Priority Data

Nov. 25, 2002 (DE) ..... 102 54 933

(51) Int. Cl.
*A43C 11/00* (2006.01)
*A43B 5/04* (2006.01)

(52) U.S. Cl. ..... 36/50.1; 36/50.5

(58) Field of Classification Search ..... 36/50.1, 36/50.5

See application file for complete search history.

(56) References Cited

U.S. PATENT DOCUMENTS

| | | | | |
|---|---|---|---|---|
| 3,845,575 A | | 11/1974 | Boden | |
| 4,083,129 A | * | 4/1978 | Collombin et al. | 36/50.5 |
| 4,408,403 A | | 10/1983 | Martin | |
| 4,539,763 A | | 9/1985 | Walkhoff | |
| 4,644,671 A | | 2/1987 | Walkhoff | |
| 4,654,985 A | | 4/1987 | Chalmers | |
| 4,677,768 A | | 7/1987 | Benoit et al. | |
| 4,694,592 A | | 9/1987 | Baggio et al. | |
| 4,739,563 A | | 4/1988 | Guggenberger et al. | |
| 4,811,503 A | | 3/1989 | Iwama | |
| 4,893,419 A | | 1/1990 | Arieh et al. | |
| 4,922,634 A | | 5/1990 | Seidel | |
| 4,937,952 A | | 7/1990 | Olivieri | |
| 4,937,953 A | | 7/1990 | Walkhoff | |
| 4,955,149 A | | 9/1990 | Ottieri | |
| 5,065,481 A | | 11/1991 | Walkhoff | |
| 5,088,211 A | | 2/1992 | Walkhoff | |
| 5,167,083 A | | 12/1992 | Walkhoff | |
| 5,175,949 A | | 1/1993 | Seidel | |
| 5,177,885 A | * | 1/1993 | Marmonnier | 36/50.5 |
| 5,249,377 A | | 10/1993 | Walkhoff | |
| 5,379,532 A | | 1/1995 | Seidel | |
| 5,381,609 A | | 1/1995 | Hieblinger | |
| 5,511,325 A | | 4/1996 | Hieblinger | |
| 5,647,104 A | | 7/1997 | James | |
| 5,657,557 A | | 8/1997 | Hull et al. | |
| 5,678,331 A | | 10/1997 | Bonaventure | |
| 5,934,599 A | | 8/1999 | Hammerslag | |
| 6,032,387 A | | 3/2000 | Johnson | |
| 6,052,921 A | | 4/2000 | Oreck | |
| 6,351,897 B1 | | 3/2002 | Smith | |
| 6,378,230 B1 | | 4/2002 | Rotem et al. | |

(Continued)

FOREIGN PATENT DOCUMENTS

| | | |
|---|---|---|
| CA | 2114387 | 8/1994 |

(Continued)

*Primary Examiner*—Anthony Stashick
(74) *Attorney, Agent, or Firm*—Goodwin Procter LLP

(57) ABSTRACT

The present invention relates to a shoe, in particular a sports shoe, having a flexible upper surrounding a foot, a closure panel arranged on an instep area of the flexible upper, and a tightening element arranged at the heel of the shoe. The tightening element is connected to the closure panel such that the closure panel, through the use of the tightening element, can be tightened against the instep area of the flexible upper to retain the shoe on the foot.

27 Claims, 11 Drawing Sheets

U.S. PATENT DOCUMENTS

| | | | |
|---|---|---|---|
| 6,438,872 | B1 | 8/2002 | Chil et al. |
| 6,474,000 | B1 | 11/2002 | Burt |
| 6,502,329 | B1 | 1/2003 | Silagy |
| 2004/0168356 | A1 | 9/2004 | Edlauer |
| 2004/0181972 | A1 | 9/2004 | Csorba |

FOREIGN PATENT DOCUMENTS

| | | | |
|---|---|---|---|
| DE | 86 00 376.3 | | 1/1986 |
| DE | 92 14 714.3 | | 11/1992 |
| DE | 92 14 715.1 | | 11/1992 |
| EP | 0 652 720 | B1 | 7/1997 |
| FR | 2 450 575 | | 3/1979 |
| FR | 2 692 115 | | 6/1992 |
| FR | 2 695 304 | | 9/1992 |
| WO | WO 95/22917 | A1 * | 8/1995 |
| WO | WO 99/09850 | | 3/1999 |

* cited by examiner

SHOE CLOSURE SYSTEM

CROSS REFERENCE TO RELATED APPLICATION

This application incorporates by reference, and claims priority to and the benefit of German patent application serial number 102 54 933.8, filed on Nov. 25, 2002.

TECHNICAL FIELD

The present invention relates to a shoe, in particular a sports shoe including a flexible upper for surrounding a foot.

BACKGROUND

Typically, shoelaces are used for securely attaching a shoe to a foot. Laces are cheap, easy to replace, and are particularly preferred for sports shoes, since their soft composition poses little risk of injury. Each time a shoelace is tied, however, care must be taken to ensure that the shoe is not too loose or too tight on the foot. Further, during wear, shoelaces can loosen or become untied.

Several alternatives to shoelaces are known from the prior art, such as hook and loop fasteners, such as the VELCRO® brand sold by Velcro Industries B.V. Other fasteners such as buckles, which extend over the instep, are also known. Hook and loop connections can be easily and quickly operated, but they wear out after a short time and require a considerable amount of attention to attain the desired tension when securing the shoe to the foot. Also, the corresponding surfaces of the fastener must be aligned correctly for a stable connection. Similarly, buckles, which have a predetermined closing movement, tend to be simple to operate; however, buckles are often excluded on shoes, in particular sports shoes, since they present a considerable risk of injury to other athletes because of the hard materials from which they are typically made. Further, they are only incrementally adjustable.

Many different closure constructions are also known from ski boots. U.S. Pat. No. 4,677,768, the disclosure of which is hereby incorporated herein by reference in its entirety, discloses a system where two levers are arranged inside each other at the end of the shaft of the ski boot, which is directed to the knee at a height corresponding approximately to the calf. The levers are used to tighten two cables. An upper cable pulls rigid anterior and posterior plastic shells together in the area of the calf and thereby closes the ski boot. The second cable pulls a free floating pressure element provided in the interior of the ski boot in the direction of the foot at an angle nominally at a midpoint between horizontal and vertical to reduce relative movement of the foot inside the boot.

The construction described above for ski boots cannot easily be transferred to shoes that are used for walking or running, since such shoes include flexible uppers, unlike a ski boot, which has a rigid outer shell. Typically, the upper in a shoe is made, for example, from leather or a soft synthetic material so that movement of the foot is not hindered while walking. In contrast to a ski boot, any closure system for a shoe having a flexible upper has to take these movements of the foot into consideration.

It is, therefore, an object of the present invention to provide a shoe with a flexible upper which can be easily, comfortably, and quickly retained on the foot, without limiting the freedom of motion of the foot necessary for unimpaired walking or running.

SUMMARY OF THE INVENTION

The invention is directed to a shoe, in particular a sports shoe having a unique structure for retaining the shoe on a foot. The shoe includes a flexible upper portion which receives the foot, a closure panel arranged on the front (instep) area of the flexible upper, and a tightening element arranged at the heel of the shoe. The tightening element is connected to the closure panel and is used to pull the closure panel against the instep area of the flexible upper.

The tightening element can be arranged at the heel part of a shoe to allow for a simple mounting of the shoe on the foot. The closure panel transforms the pulling movement into a contact pressure, which acts on the large instep area and assures, as in a common, tightly laced shoe, a secure, but locally flexible attachment on the foot. Relative movements of single parts of the foot causing a compression or a stretching of the flexible material of the upper are still possible when the shoe is worn. Furthermore, the even pressure distribution avoids a premature fatigue of the upper material. In contrast to closure systems of the prior art, there are no high tensile forces acting on the upper of the shoe, as is the case with shoelace eyelets, just a relatively uniform distributed load.

Once the tightening element has been adjusted to an individual foot, the shoe can be secured by a simple action, i.e., the operation of the tightening element. The shoe can therefore be taken on and off in a very short time, for example to relax or to massage the foot during a short break of a game.

In one aspect, the invention generally relates to a shoe including a flexible upper for receiving a foot, a closure panel arranged at an instep area of the flexible upper, and a tightening element coupled to the closure panel and arranged at a heel region of the shoe. The tightening element operatively retains the shoe on the foot by biasing the closure panel against the instep area. In some embodiments, the closure panel includes a foam layer on a side proximate the upper for improved wearer comfort, and the closure panel may define one or more ventilation openings.

In various embodiments, the closure panel three-dimensionally encompasses the instep area of the upper. The closure panel can include a side region extending to at least one of a lateral rear side and a medial rear side of the shoe for connecting the closure panel to the tightening element. In addition, the shoe can include at least one of a lateral receiving element and a medial receiving element, wherein a portion of the closure panel is slidable within the receiving element when the tightening element is operated to bias the closure panel against the instep area of the upper in a predetermined manner and orientation. In one embodiment, the receiving element encompasses a rear portion of the upper from below the upper. Thus, the receiving element forms the counterpart of the closure panel arranged on the outside of the instep area and thereby assures that the foot is securely encompassed by the shoe from all sides when the tightening element is operated. Further, the receiving element provides an improved contact of the foot to the sole. This arrangement of the closure panel leads to a pressure that is distributed also on the side regions and thereby avoids local pressure points on the sensitive tissue of the instep. Further, the three-dimensional encompassing provides a particularly secure seating of the shoe on the foot. The side regions may be manufactured from a different material than the closure panel itself, in particular from a slightly elastic material to allow a slight yielding under excessive forces.

In additional embodiments, the closure panel includes a side region projecting to at least one of a lateral front side and a medial front side of the shoe, the side region of the closure panel attached to at least one of a lower forefoot portion of the upper and a sole of the shoe, which can result in additional stabilization of the overall shoe construction. It is also possible to attach the side regions to the shoe at a toe cap of the shoe. Thus, the tension provided by the tightening element is distributed starting from the heel region up to the forefoot region and therefore assures an evenly distributed contact pressure of the mounted shoe over the complete foot.

In various embodiments, the tightening element is connected to the closure panel by a pulling element to transmit a force to the closure panel. The pulling element can include at least one sheathed cable extending from the tightening element to the closure panel. The result is easy operation of the tightening element, because the use of a sheathed cable reduces the frictional forces when the pulling movement (force) is transmitted from the heel to the closure panel arranged on the instep area. Apart from a sheathed cable, a variety of other tightening elements and force transmission components may be used. In one embodiment, the cable extends on both a lateral side of the shoe and on a medial side of the shoe from the tightening element to the closure panel. Thus, an even pulling load is exerted on the closure panel. Additionally, the cable may extend at least partially below an insole of the shoe, which avoids the cable extending too far to the side of the shoe, thereby reducing the risk of injury. It is, however, also possible to guide the cable exclusively along the outer sides of the shoe. Furthermore, the pulling element is securable to the closure panel at, at least two different locations. This arrangement allows a wearer to modify the extent of the pulling movement occurring by operation of the tightening element, thereby adjusting the shoe to the individually varying dimensions of a foot within one shoe size.

Moreover, the tightening element can include a lever mechanism that includes a pivotable lever couplable to a pulling element. The lever can be attached releasably to the heel region of the shoe. In one embodiment, the lever includes an axis and the heel region includes a plurality of receptacles into which the axis of lever can be releasably received or locked. In another embodiment, the heel region includes a plurality of upwardly directed projections defining grooves adapted for releasably receiving the lever.

The pulling element can be coupled to the lever via an adjustment mechanism to adjust a force applied to the pulling element caused by pivoting the lever. The adjustment mechanism allows the wearer to adjust the amount of pulling movement caused by a movement of the lever. Therefore, the wearer is provided with a manner of adjustment in addition to the above discussed different fastening positions of the pulling element at the closure panel. The adjustment element at the lever may, for example, provide a fine-tuning; whereas, the different fastening positions provide for a coarse adjustment.

In one embodiment, the pulling element, and hence the shoe, is tightened by upwardly pivoting the lever. In an alternative embodiment, the pulling element can be guided so as to result in a tightening of the shoe by downwardly pivoting the lever. Either arrangement results in a particularly easy operation of the tightening element, requiring minimal attention from the wearer of the shoe.

In one embodiment, the adjustment mechanism includes a slide moveable along the lever for receiving the pulling element and an adjustment screw attached to the lever; wherein, operation of the adjustment screw causes a movement of the slide along the lever. The adjustment screw can be arranged so as to be adjustable independently of a position of the lever and can include an operating head arranged at an end of the lever remote from a pivot for rotating the adjustment screw. This allows the wearer to adjust the tension not only in the released state, but also when the lever is upwardly pivoted.

Accordingly, the wearer of the shoe may perform a coarse adjustment before closing, subsequently upwardly pivoting the lever for tightening and finally exactly define, by means of the adjustment screw, the amount of tension desired for his or her individual needs. When the lever is tilted down for taking off the shoe, the previously defined adjustment remains fixed. Therefore, the shoe has the same well-fittingly adjusted seat at the foot when the shoe is closed again by pivoting the lever; however, the complete adjustment may as well be performed by means of the adjustment screw before the lever is actuated.

In additional embodiments, the heel defines a recess for at least partially receiving the lever mechanism. Thus, the risk of injuries is reduced, since the lever mechanism does not project or only slightly projects beyond the recess. The lever can be secured in the recess in an upwardly pivoted position, and at least one of the lever and the recess can include structure to retain the lever in the recess of the shoe, such as a detent. Securing the lever in the upward position inside the recess of the heel part avoids an unintended release of the lever in the case of strong shocks, for example during the landing after a high leap. The lever can be releasably mounted to the heel part, which allows the wearer to completely separate the lever from the shoe, either for maintenance or for cleaning purposes or to maximize the size of the shoe opening facilitating entry of the foot into the shoe. This may, for example, be important for persons having a very high instep, such that the shoe must be opened to a particularly great extent to receive the wearer's foot.

In another aspect, the invention generally relates to a tightening system for a shoe. The system includes a closure panel disposed about an instep portion of the shoe and a tightening element coupled to the closure panel and arranged at a heel of the shoe. The tightening element operatively adjusting the pressure applied by the closure panel on the instep portion of the shoe. The pressure is applied along a primary loading path of the tightening element, which is disposed at an acute angle relative to a ground engaging surface of the shoe. In various embodiments, the tightening element is disposed at an angle of less than 45 degrees relative to the ground engaging surface, preferably in a range of about 20 degrees to about 35 degrees, and more preferably at a range of about 25 degrees to about 30 degrees, nominally about 27 degrees.

These and other objects, along with the advantages and features of the present invention herein disclosed, will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the present invention are described with reference to the following drawings, in which.

DETAILED DESCRIPTION

Embodiments of the present invention are described below. It is, however, expressly noted that the present invention is not limited to these embodiments, but rather the intention is that modifications that are apparent to the person skilled in the art are also included. In particular, the present invention is not intended to be limited to athletic shoes, but rather it is to be understood that the present invention can also be in any of a variety of shoes with flexible uppers, for example a running shoe, a basketball shoe, or a common street shoe.

Figure 1A:
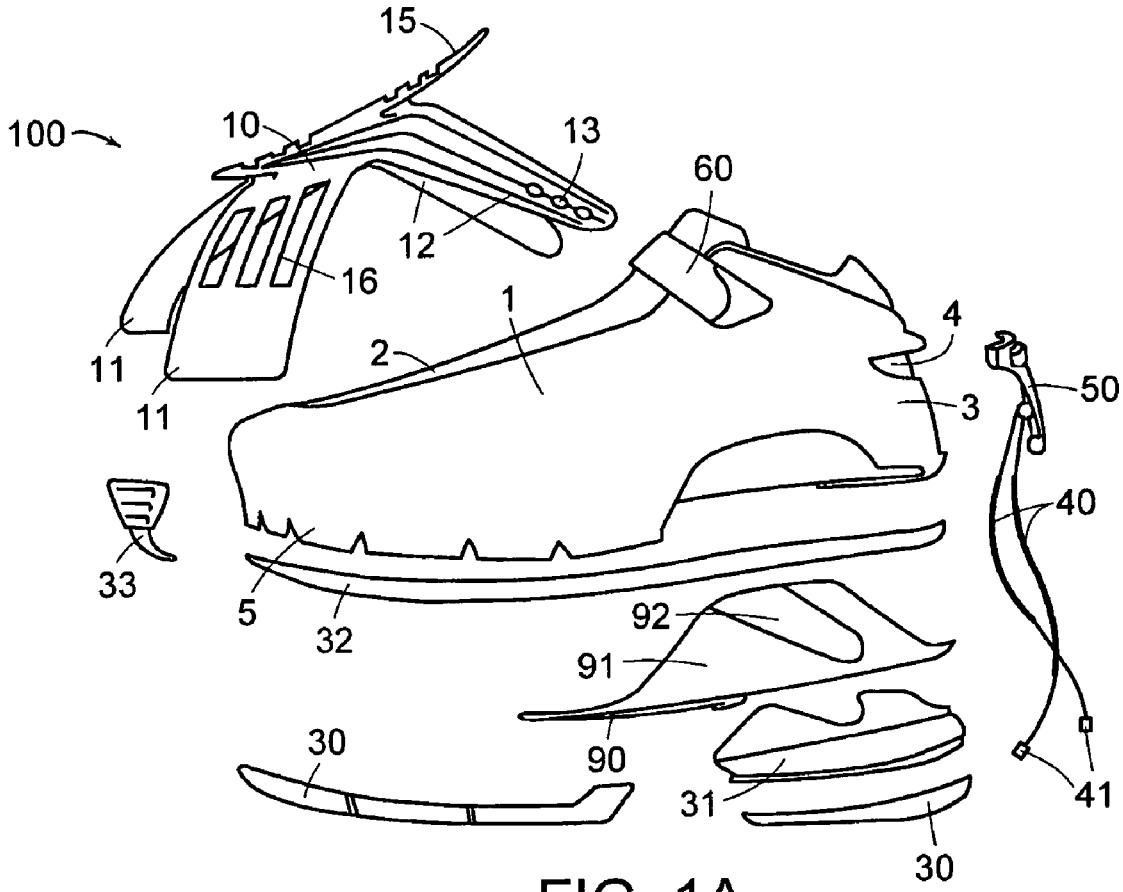
FIG. 1A is an exploded schematic perspective view of a shoe including a shoe closure system in accordance with one embodiment of the present invention.

FIG. 1A shows an exploded view of one embodiment of a shoe 100 in accordance with the present invention. The shoe 100 includes an outsole 30, a heel wedge 31, a midsole 32 and a toe cap 33. A closure panel 10 is arranged above an upper 1, the upper 1 being made from a conventional flexible material, such as a synthetic mesh material or leather. The closure panel 10 is arranged on the outside of the instep area 2 of the upper 1. To improve contact between the closure panel 10 and the instep area 2, the instep area 2 may be slightly recessed from the upper 1, with the closure panel 10 adaptively fitting into the recess.

Figure 1B:
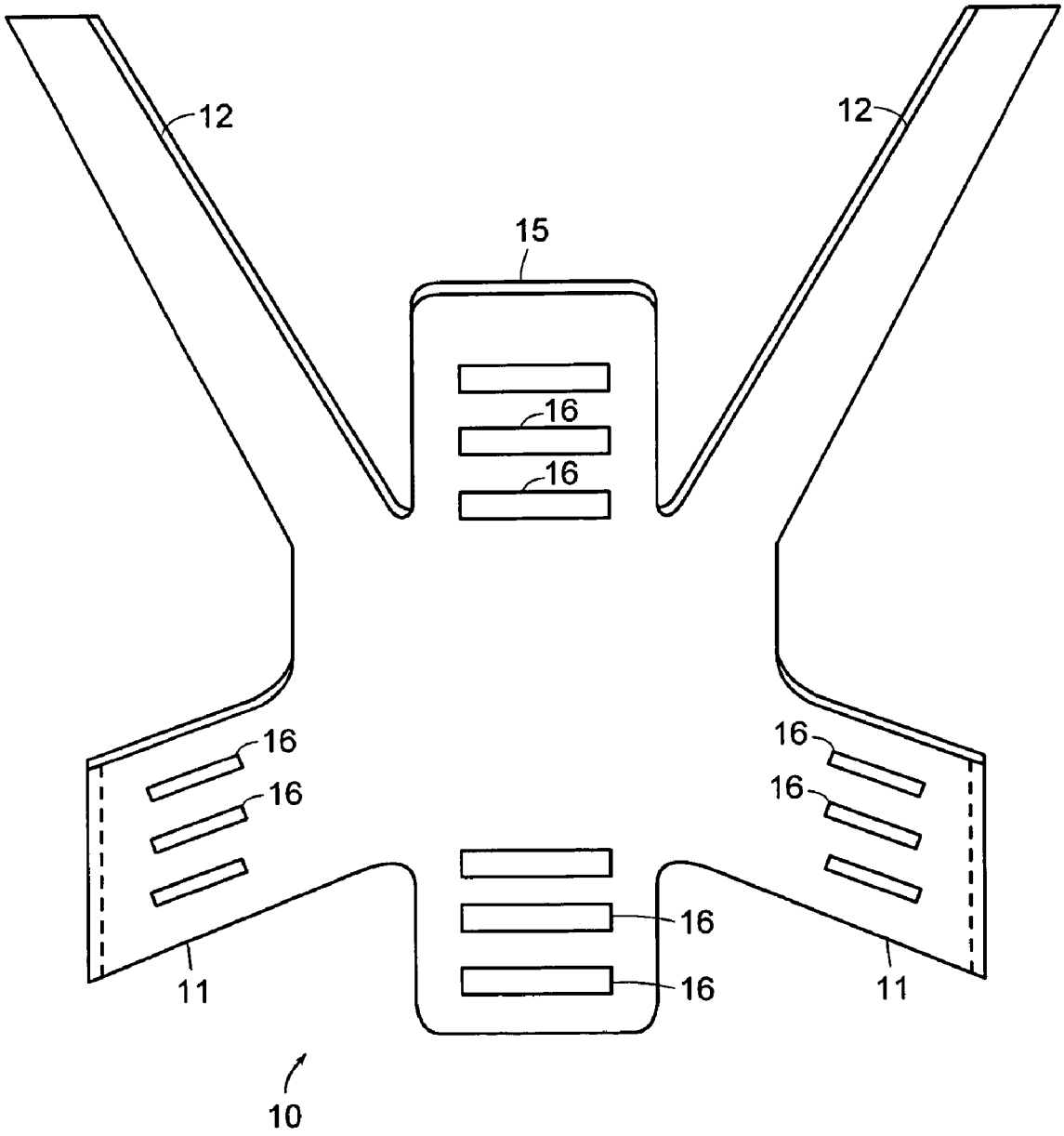
FIG. 1B is a top view of a closure panel for use in the system of FIG. 1A.

The closure panel 10 is generally shaped to distribute pressure to the side regions of the shoe 100 to avoid excessive pressure on the sensitive instep area of the foot. The three-dimensional shape of the closure panel 10 also provides a particularly secure seating of the shoe 100 on the foot. In one embodiment, the closure panel 10 is shaped like a three-dimensionally curved X (FIG. 1B) and includes projections or extensions 11, 12 extending to the lateral rear, the medial rear, the lateral front, and the medial front of the shoe 100. The projections 11, 12 may be manufactured from a different material than the body of closure panel 10, in particular from a slightly elastic material to allow a slight yielding under excessive forces. The projections 11 of the closure panel 10 extending to the front of the shoe 100 are attached to the lower forefoot part 5 of the upper 1 or can surround the outsole 30 of the shoe 100 from below. In an embodiment where the projections 11 of the closure panel 10 extend to the front and surround the outsole 30, the lateral and the medial projections 11 extending to the front may be connected together. In another embodiment, the toe cap 33 may be coupled to the lateral and medial projections 11. In still other embodiments, the projections 11 can extend under the upper 1, between either the upper 1 and the midsole 32 or the midsole 32 and the outsole 30. The front projections 11 anchor the closure panel 10 to the shoe 100 in a generally fixed position.

The projections 12 extending to the rear of the shoe 100 transmit a pulling movement (force arrows 7 in FIG. 2) to the closure panel 10. The pulling movement originates from a lever mechanism 50 at the heel 3 and is transmitted to the projections 12 by means of a pulling element 40, such as a sheathed cable 40. In other embodiments, the pulling element 40 could be a cord, a tape, a fine-linked chain, or in general, any other force transmission element.

Pulling the closure panel 10 rearwardly with the lever mechanism 50 presses the closure panel 10 downwardly and rearwardly against the upper 1 of the shoe 100, thereby retaining the shoe 100 on the foot. The tension provided by the lever mechanism 50 is distributed from the heel 3 to the front of the forefoot 5 by the closure panel 10 and the closure panel 10 helps assure an evenly distributed contact pressure of the shoe 100 against a wearer's foot. The amount of pulling determines how tightly the shoe 100 fits on the foot. Since the upper 1 is flexible, the foot can still move inside the shoe 100 closed according to the present invention. This is desirable for unhindered walking and additionally avoids irritation of the sensitive instep portion of the foot.

To help transmit the force from the lever mechanism 50 to the closure panel 10, one or more receptacles 13 for the pulling element 40 are provided. The receptacles 13, which may be recesses or eyelets, are arranged in different positions along the rearwardly extending projections 12. By attaching the front ends 41 of the cables 40 in different receptacles 13, the shoe 100 can be adjusted to accommodate individuals with varying foot size and instep height. For instance, it is possible to attach the cable 40 on the medial side of the shoe 100 to a different receptacle 13 than on the lateral side of the shoe 100. This will result in a different contact position of the closure panel 10 on the lateral side of the shoe 100 and on the medial side of the shoe 100. In another embodiment, independent adjustment of the pulling movement on the medial and the lateral side can be attained by providing separate cables 40 for each side. The cable 40 can include a formed end 41 that seats within the receptacles 13. Alternatively or additionally, the cable 40 can be attached directly to the closure panel 10 and by a variety of mechanical means, such as bonding or fasteners.

Figure 2:
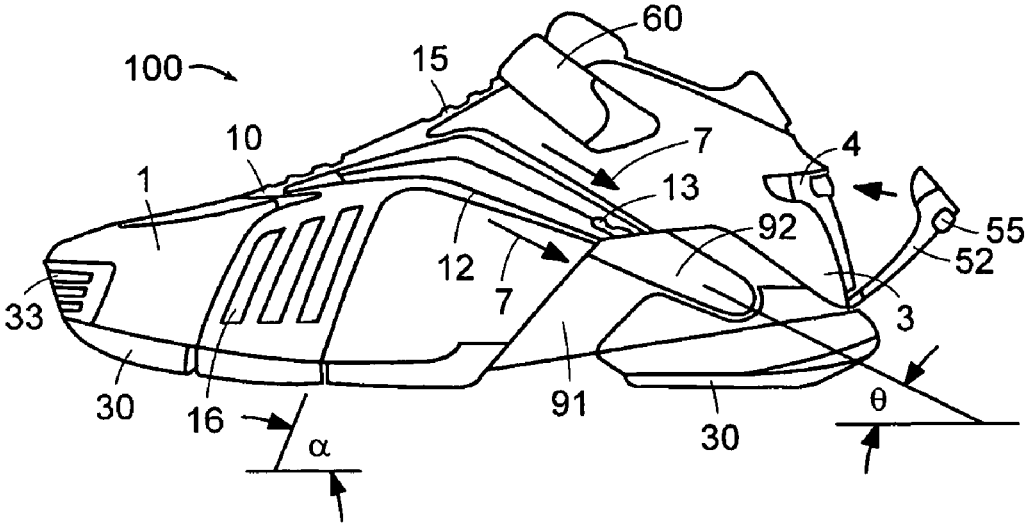
FIG. 2 is a schematic side view of the shoe of FIG. 1A.

With continued reference to FIG. 1A, the closure panel 10 optionally includes a further extension 15 extending upwardly on the instep area 2 of the upper 1, similar to a tongue of a common shoe. The extension 15 further helps to position the closure panel 10 on the instep area 2 of the upper 1 and can be received slidably in a suitably configured pocket formed in the upper or the tongue. The extension 15, as well as the other parts of the closure panel 10, may be provided with openings 16 to improve ventilation of the shoe 100 interior. Further openings may be provided in the upper 1 and may, if necessary, overlap with the openings 16 in the closure panel 10. In different embodiments, the size and the number of the openings in the closure panel can vary depending on the field of use of the shoe 100 and the need to provide breatheability. In addition to the closure panel 10 previously described, other common closure elements may be arranged on the upper 1. For example, FIGS. 1A and 2 show a hook and loop fastener connection 60 closing the topmost part of the upwardly extending upper 1 of the shoe 100.

Figure 3:
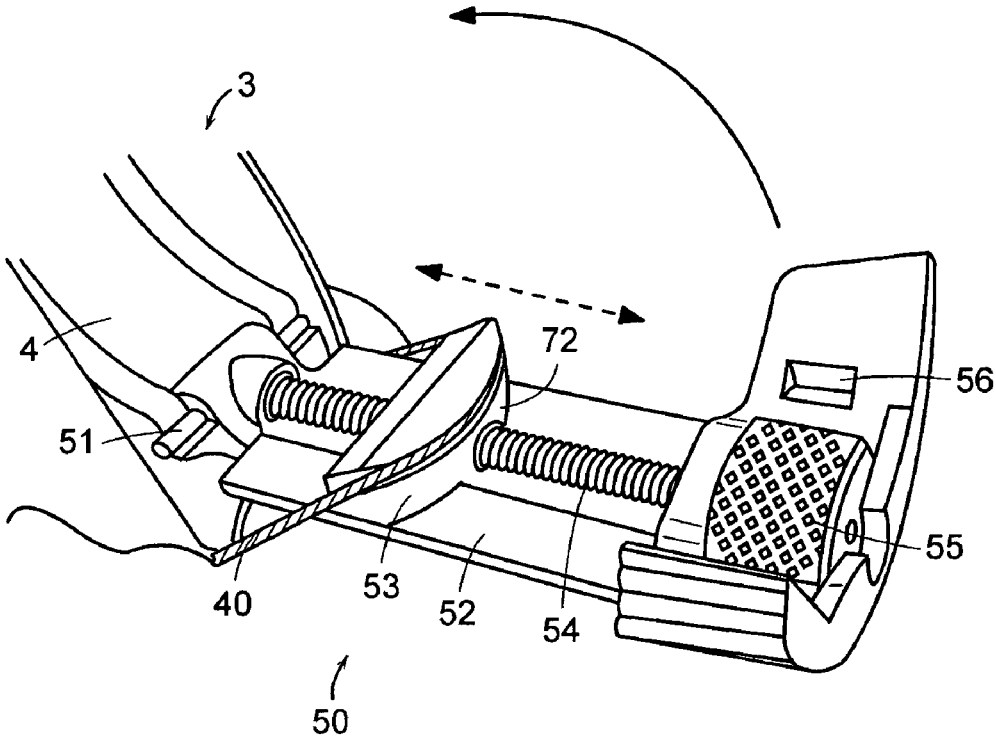
FIG. 3 is a schematic perspective view of a portion of a shoe closure system in accordance with one embodiment of the invention.

FIG. 3 shows one embodiment of a lever mechanism 50 for tightening the pulling element 40 in accordance with the invention. As shown, the lever mechanism 50 is situated in a recess 4 in the heel 3 of the shoe 100. The lever mechanism 50 includes a lever 52 that is rotatably mounted about a pin 51. When the lever 52 is pivoted into the heel 3, the lever 52 fits into the recess 4 and, therefore, only slightly projects from the heel 3. In various embodiments, the lever 52 can be rotatably mounted such that it pivots upwardly or downwardly into the heel 3 to tighten the closure panel 10; however, it may-be preferable to mount the lever 52 such that it pivots upwardly into the heel 3 so that an unintended release of the lever 52 is avoided in the case of a strong shock. When the lever 52 is pivoted into the heel 3, it can be locked in the recess 4 of the heel 3. To lock the lever 52, small latching projections or recesses 56 that are arranged on the lever 52 interact with corresponding latching elements or detents of the heel 3.

An adjustment element, such as a slide 53, is also mounted inside a groove on the lever 52. The cable 40 is guided around a top portion 72 of the slide 53. An adjustment screw 54 is also included in the lever 52 and extends through the slide 53. The adjustment screw 54 has at its upper end an operating head 55 that when rotated changes the position of the slide 53 within the lever 52. In one embodiment, the adjustment screw 54 is arranged in the lever 52 such that an adjustment is possible independent of the position of the lever 52. This allows a user to adjust the tension applied by the pulling element 40 not only when the lever 52 is in a released position, but also when the lever 52 is pivoted and locked into the heel 3. As the position of the slide 53 in the lever 52 is altered, the amount of tension that is provided to the closure panel 10 when the lever 52 is pivoted into the heel 3 is changed as well. Therefore, the adjustment element 53 allows the user to adjust the amount of pressure applied by the closure panel 10 on the upper 1 as a result of the pivoting of the lever 52. In one embodiment, the adjustment screw 54 has metric threads; however, the use of any relatively fine-pitch thread is possible, if a particular fine tuning of the contact pressure of the closure panel 10 is desired. A "self-locking" type thread, such as a buttress thread, may be advantageously employed to prevent inadvertent loosening, during use. In another embodiment, the adjustment element 53 can include a course and a fine adjustment, so that a wearer of the shoe 100 can more easily attain a desired tightness of the shoe 100 on the foot. In this embodiment, the wearer of the shoe 100 may perform a coarse adjustment before pivoting the lever 52 into the recess 4 in the heel 3, and then perform a fine adjustment after the lever 52 has been pivoted into the shoe 100. When the lever 52 is pivoted out of the recess 4, the previously defined adjustment remains fixed so that when the lever 52 is tightened again, the desired fit will again be achieved. As an alternative, the wearer can also complete adjustment of the pulling element 40 before the lever 52 is pivoted into the heel 3.

Instead of utilizing a single cable 40 as described above, the ends 41 of which are respectively attached to the projections 12, in another embodiment, separate cables for the medial and lateral side may be provided. In this embodiment, two independent adjustment mechanisms can be arranged in the lever mechanism 50 to enable independent adjustment of the cables 40 that apply force to the closure panel 10.

Figure 4:
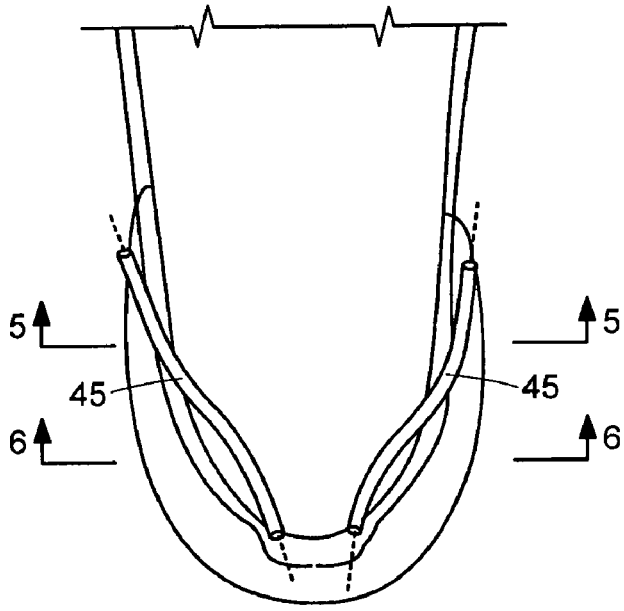
FIG. 4 is a schematic top view of a cable arrangement for use in a shoe closure system in accordance with one embodiment of the invention.
Figure 5:
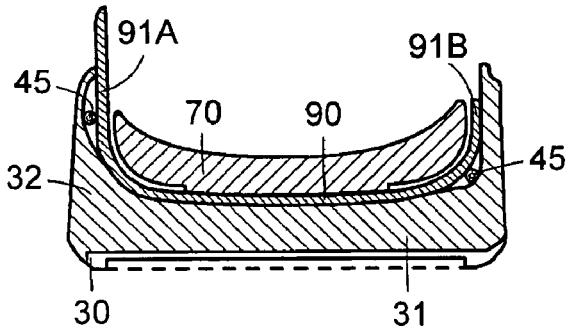
FIG. 5 is a schematic cross-sectional view of the shoe of FIG. 4 taken along line 5—5 of FIG. 4
Figure 6:
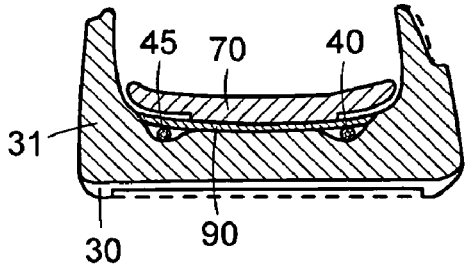
FIG. 6 is a schematic cross-sectional view of the shoe of FIG. 4 taken along line 6—6 of FIG. 4.

FIGS. 4–6 illustrate the arrangement of the sheathed cable 40 within the shoe 100. As can be seen in FIGS. 4–5, the sheathed cable 40 extends from the closure panel 10 along the side of the shoe towards the heel 3 of the shoe. As the sheathed cable 40 approaches the heel 3 of the shoe 100, the sheathed cable 40 travels below an insole 70 (FIG. 6).

The arrangement of the sheathed cable 40 avoids an increase in the lateral and medial thickness of the shoe over a larger area. In addition, the cable 40 in the heel 3 is brought into the required position to interact with the lever mechanism 50. FIG. 5 shows an embodiment where the sheath 45 of the cable 40 is covered by the upwardly extending midsole 32 and/or the heel wedge 31 and/or the outsole 30, such that it is not exposed to the exterior of the shoe. In another embodiment, the cable 40 can be guided along the outer sides of the shoe 100. For a smooth pulling action, the cable 40, as well as the inner surfaces of the sheath 45, can be coated with a friction-reducing material, for example Teflon® sold by DuPont, Inc. or a similar substance.

As an alternative to the separate sheaths 45 shown in FIGS. 5 and 6, the receiving element 90 may also include integrally formed cable conduits. Although the presence of the cable conduits may render manufacturing of the receiving element 90 slightly more complicated, the conduits facilitate shoe assembly.

FIGS. 1A, 5 and 6 show the receiving element 90. The receiving element 90 includes recesses 92 in its medial and lateral side regions 91A, 91B, the shape of which correspond to the rearwardly directed projections 12 of the closure panel 10. When the lever mechanism 50 is operated to pull the closure panel 10 against the instep area 2 of the flexible upper 1, the projections 12 are guided into the recesses 92. The recesses 92 are preferably arranged on the inner side of the side regions 91 of the receiving element 90 so that the sliding movement of the projections 12 is not impaired by dirt. In one embodiment, the receiving element 90 encompasses the rear part of the upper 1 from below. Therefore, the receiving element 90 forms a mating counterpart of the closure panel 10 arranged on the outside of the instep area 2 and thereby assures that the foot is securely held from all sides by the shoe 100 when the lever mechanism 50 is operated. Further, the receiving element 90 provides an improved contact of the foot to the sole. In another embodiment, the heel wedge 31 arranged below the receiving element 90 may have a shape on its side regions corresponding to the side regions 91 of the receiving element 90 (FIGS. 1A and 2).

Figure 7A:
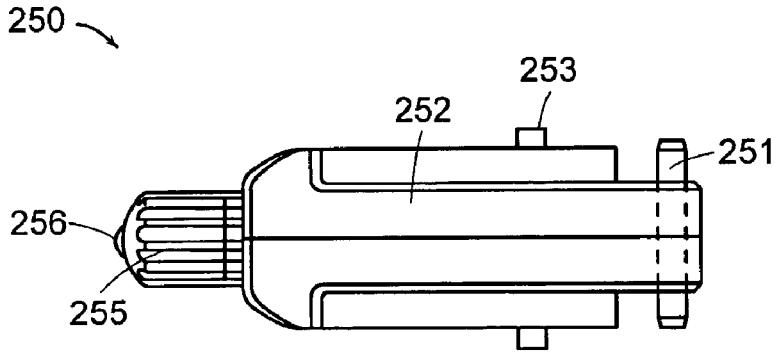
FIG. 7A is a schematic top view of a portion of an alternative embodiment of a shoe closure system in accordance with one embodiment of the invention.
Figure 7B:
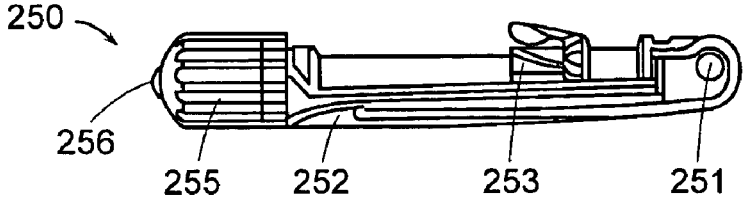
FIG. 7B is a schematic side view of the portion of the system of FIG. 7A.

FIGS. 7A and 7B depict an alternative embodiment of a lever mechanism 250 in accordance with the invention. Whereas in FIG. 3, the operating head 55 is arranged in the curved end part of the lever 52, the operating head 255 in the present embodiment forms the topmost end of the lever 252; however, in both embodiments it is possible to rotate the operating head 255 independently from the position of the lever 252 so that the user may adjust the contact pressure when the lever 252 is pivoted into the heel 203. For an easier operation, the operating head 255 can include a roughened surface, for example by being knurled (FIG. 3) or fluted (FIG. 7A).

In another embodiment, the lever can be mounted releasably to the heel such that the lever can be completely separated from the shoe either for maintenance or to maximize the size of the shoe opening to facilitate entry of a wearer's foot into the shoe. This may be particularly helpful for an individual with a high instep or other anatomical peculiarities. In this embodiment, the pin may, for example, be mounted releasably in the recess of the heel to allow a complete release of the cable. Releasing the cable enlarges the entrance opening of the shoe, since the closure panel can be displaced, to a great extent, from the instep area.

Figure 8A:
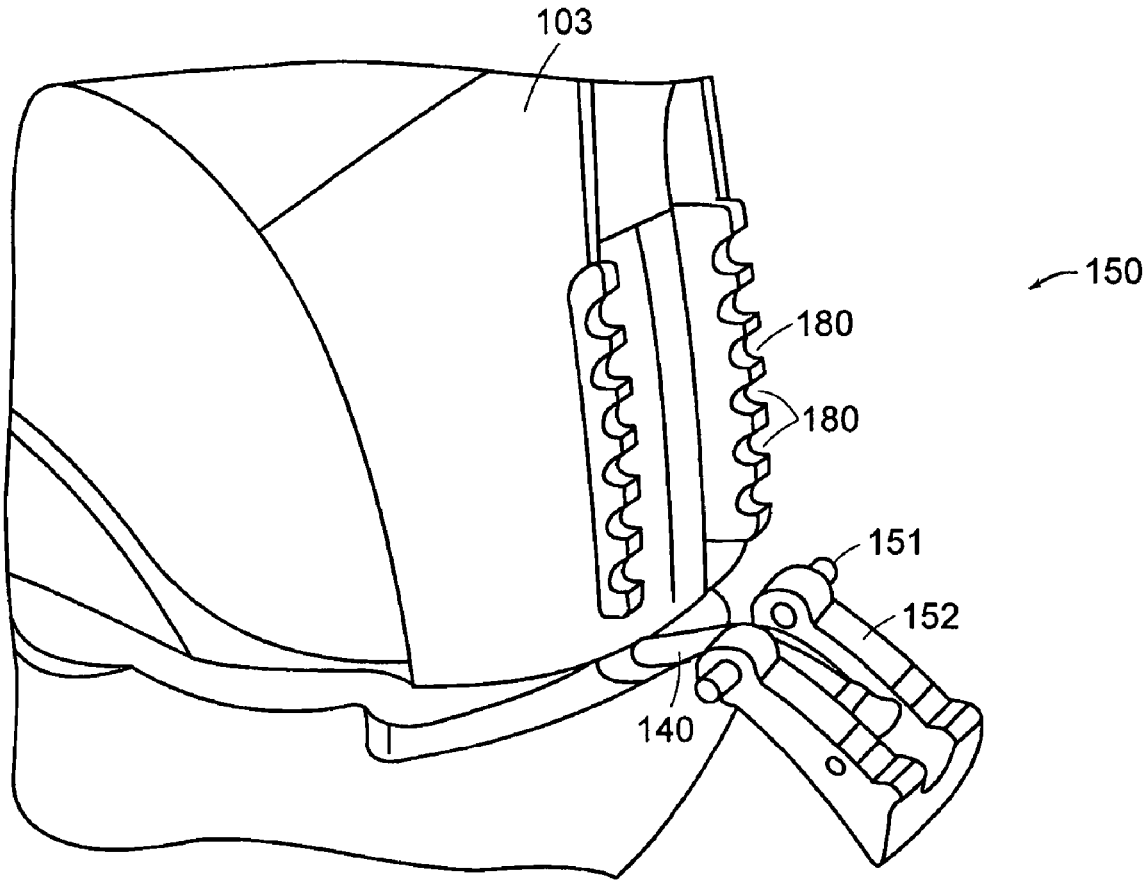
FIGS. 8A–8C are schematic perspective views of a portion of an alternative embodiment of a shoe closure system in accordance with one embodiment of the invention.
Figure 8B:
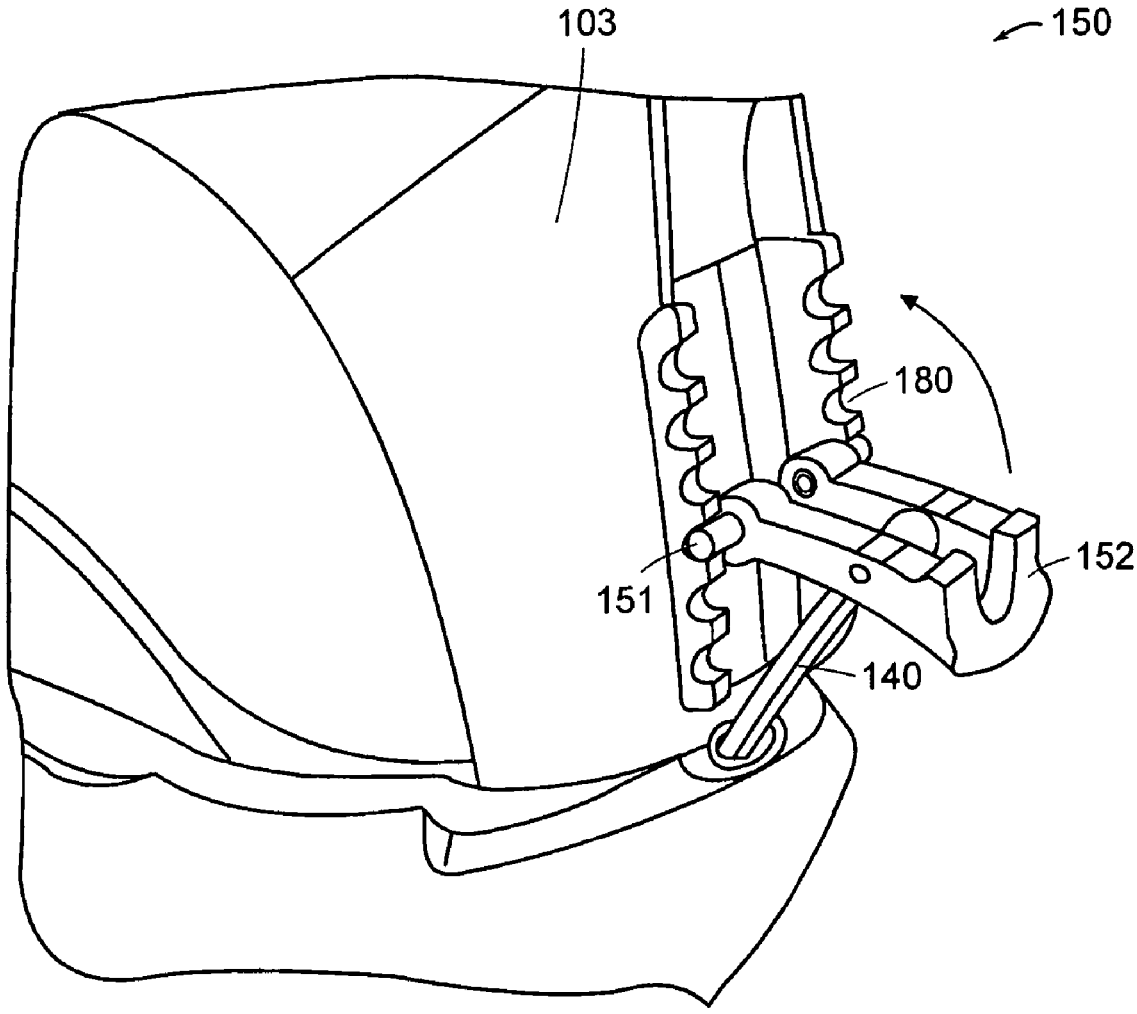
Figure 8C:
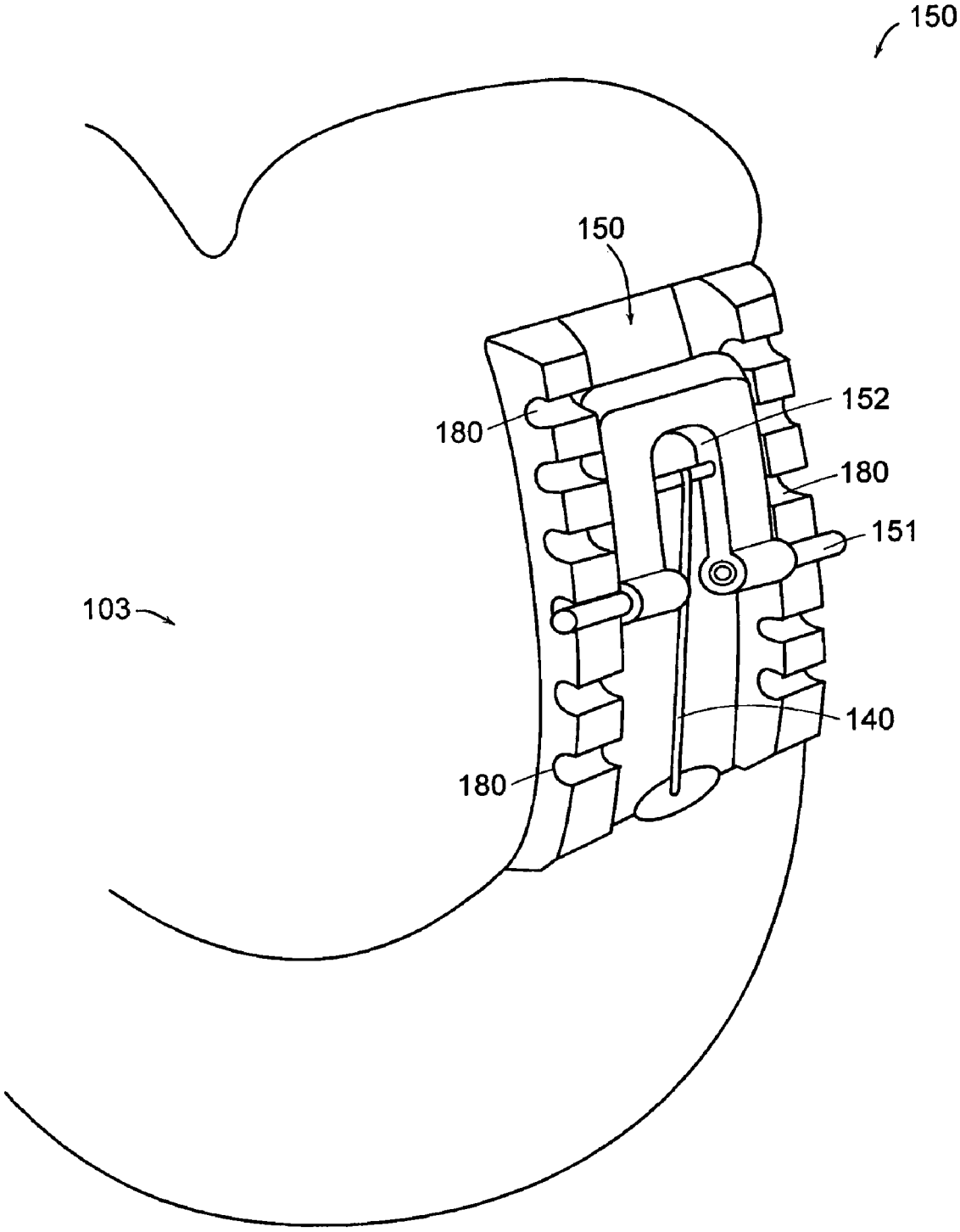

FIGS. 8A–8C depict another alternative embodiment of a lever mechanism 150 in accordance with the invention. In this embodiment, the heel 103 of the shoe is provided with a plurality of pin recesses or receptacles 180 at differing heights into which a pin or axis 151 of the lever mechanism 150 can be received and pivoted. In one embodiment, the axis 151 can be locked within the receptacle 180. If a wearer selects a recess 180 located near the top of the heel 103, the displacement of the cable 140 will be relatively large when the lever 152 is pivoted into the heel 103. A large displacement of the cable 140 results in the closure panel 110 fitting more closely around the instep area 102 of the shoe. Conversely, if a wearer selects a recess 180 at a lower height, the displacement of the cable 140 will be lower. As can be seen in FIG. 8A, the axis 151 can be disconnected from the recess 180 to enable a wearer of the shoe to easily remove or put on the shoe. In a further embodiment, the lever mechanism can be combined with a screw adjustment. In this embodiment, a coarse adjustment could be achieved by selecting a desired recess and a fine adjustment could be made by operating the adjustment screw.

Figure 9:
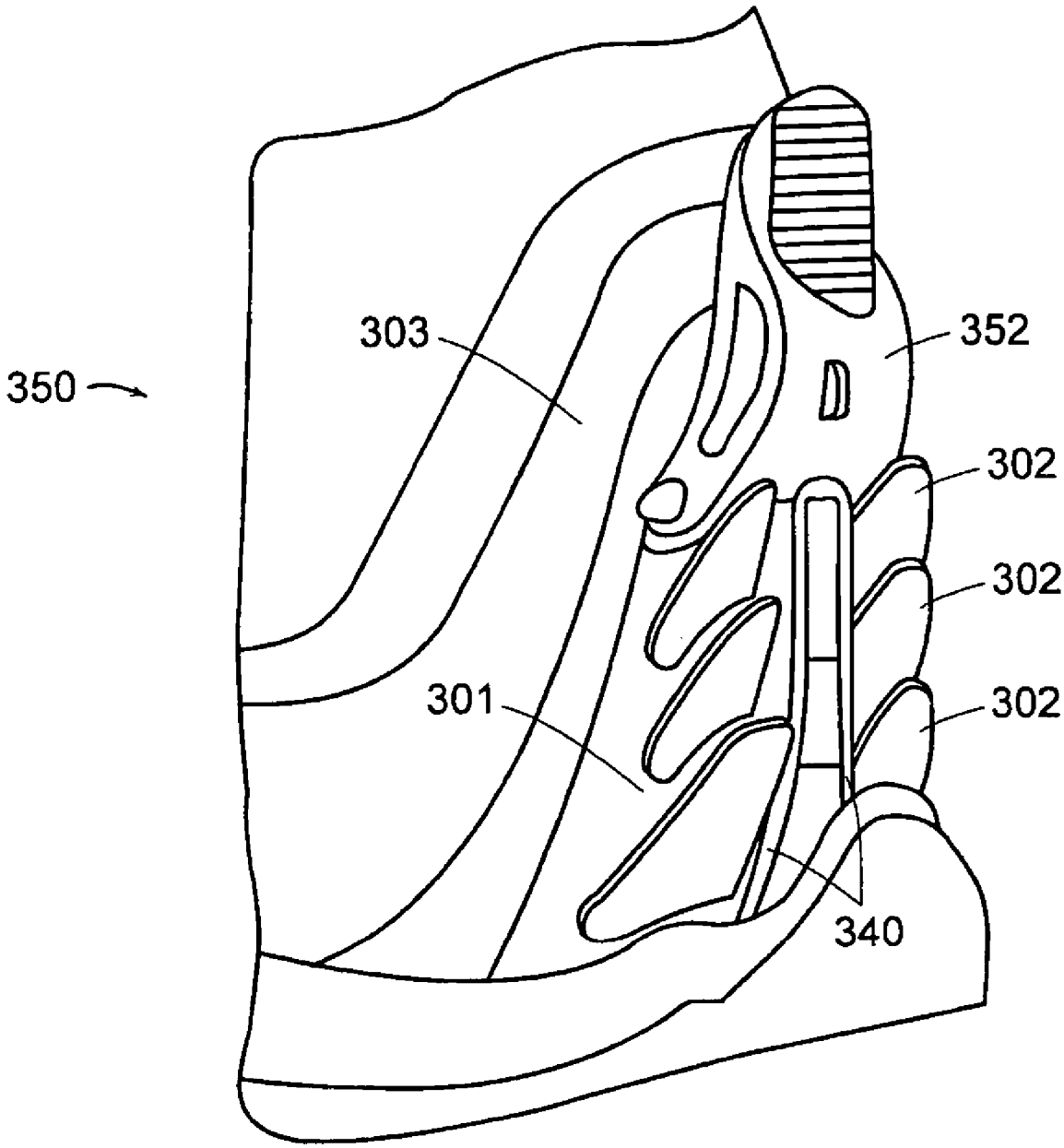
FIG. 9 is a schematic perspective view of a portion of another alternative embodiment of a shoe closure system in accordance with one embodiment of the invention.

FIG. 9 depicts another alternative embodiment of a lever mechanism 350 for use in a closure system in accordance with the invention. The lever mechanism 350 includes a lever 352 and a pulling element 340 similar to those previously described; however, the lever 352 does not include an axis. The heel 303 includes a series of upwardly directed projections 302 that define a series of grooves 301 that are adapted to receive the lever 352. The grooves 310 are located at varying heights along the heel region 303 to provide the wearer with the ability to vary the fit of the closure system. Specifically, the wearer determines the fit of the shoe based on which groove 301 the wearer places the lever 352 into. For example, if the wearer selects a groove 301 located at the top of the heel 303, the tension on the pulling element/cable 340 will be high, and the closure panel will fit tightly around the instep of the shoe. The opposite is true if the wearer selects a groove 301 located at the bottom of the heel 303. In addition, the lever mechanism 350 can be combined with a screw adjustment to facilitate finer adjustments.

Figure 10A:
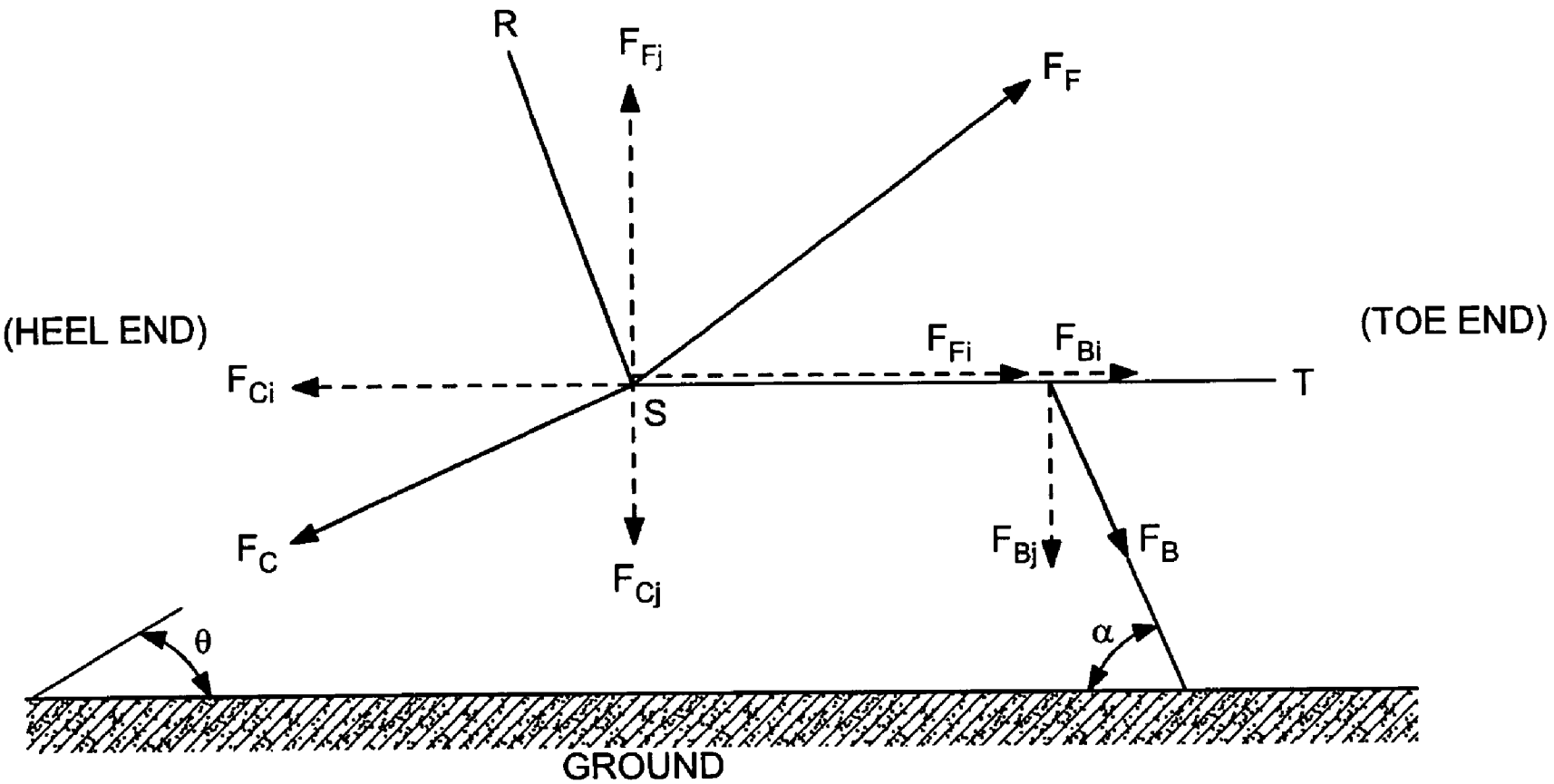
FIGS. 10A–10C are force vector diagrams representing the force distribution of the shoe closure system shown in FIG. 2.
Figure 10B:
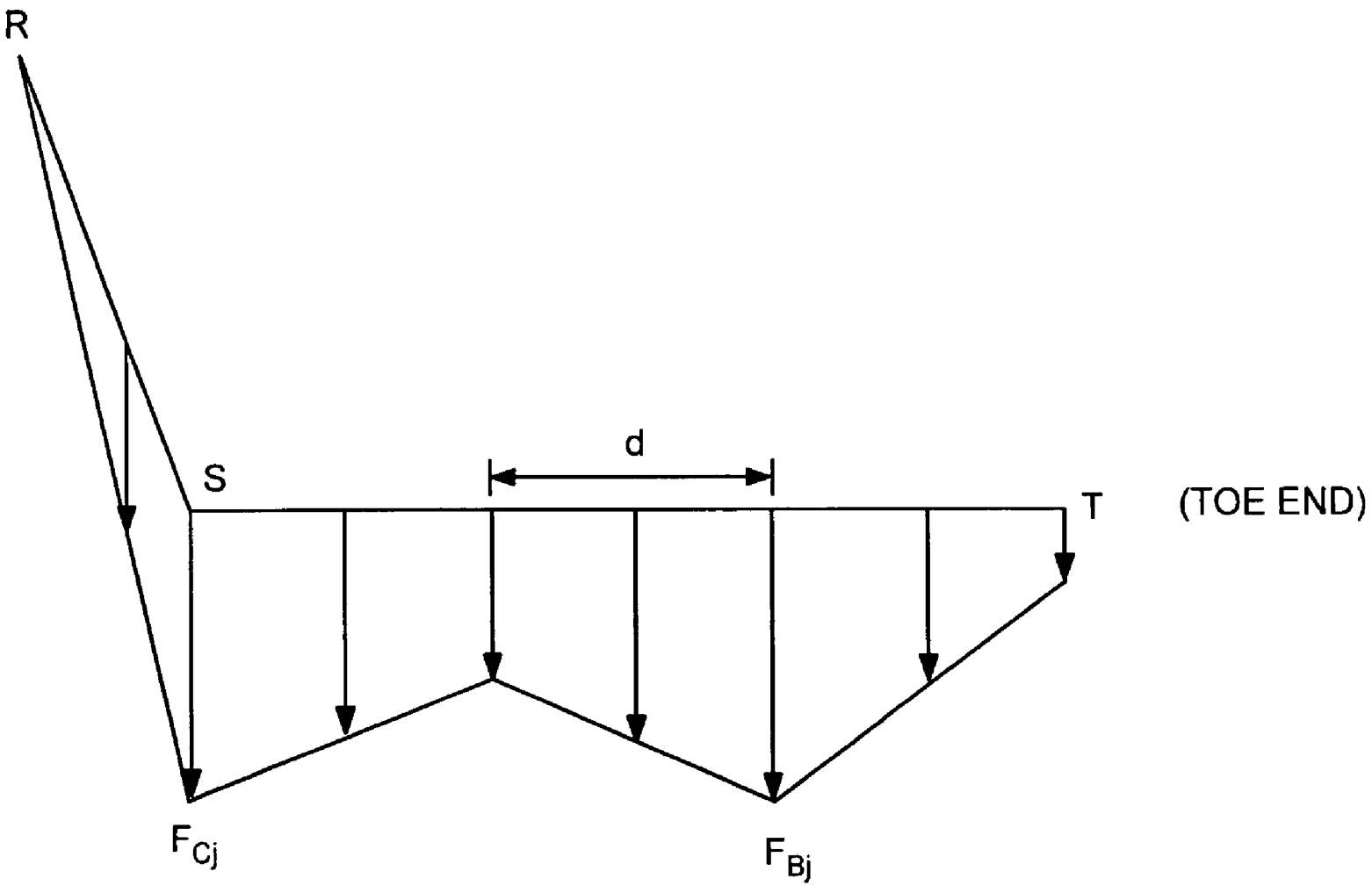
Figure 10C:
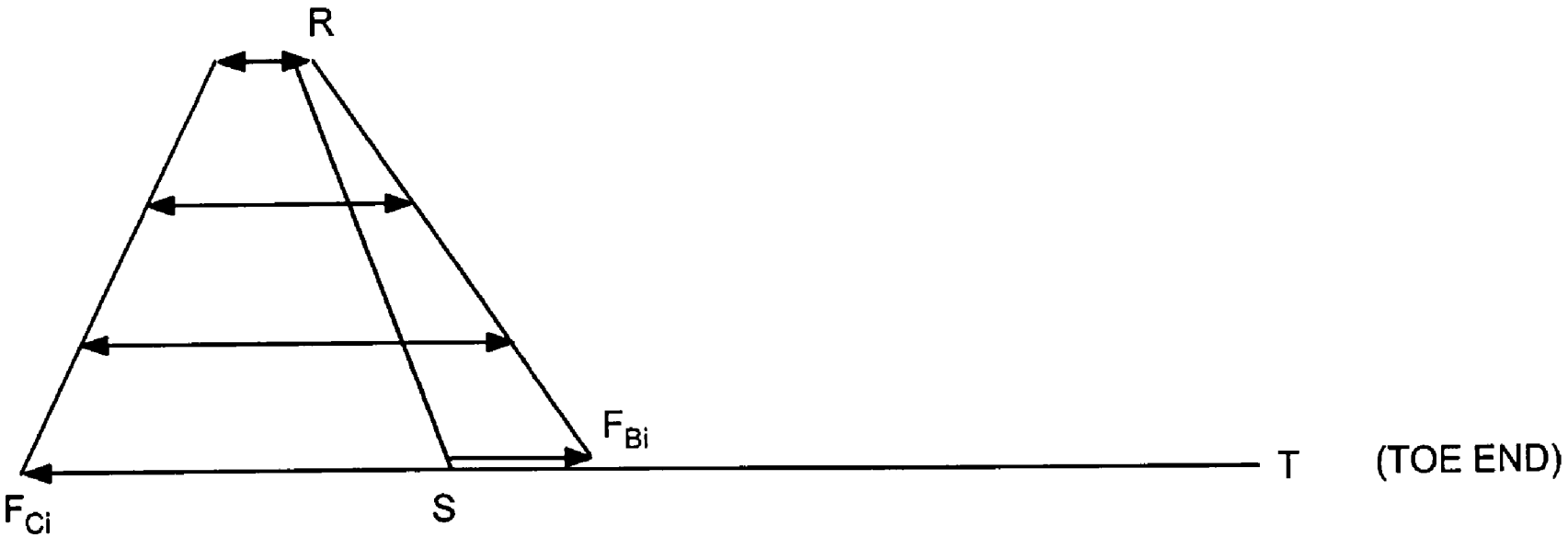

FIGS. 10A–10C depict typical schematic force vector diagrams indicating generally the relative forces acting on the closure panel 10 (line RST) and shoe 100 as viewed from a side of the shoe 100. The three forces acting on RST are depicted generally as $F_F$, $F_C$, and $F_B$. Specifically, $F_F$ depicts the reaction forces generated by the foot on the closure panel 10; $F_C$ depicts the forces generated by the cable 40; and $F_B$, the forces generated by the projection 11. On the diagram, the horizontal and vertical components of each force are indicated by the subscripts $_i$ and $_j$, respectively.

As can be seen in FIG. 10A, the cable horizontal force component $F_{Ci}$, is generally greater in magnitude than the vertical force component $F_{Cj}$ of the cable force $F_C$. As angle θ becomes more acute relative to the ground engaging surface of the shoe, the magnitude of $F_{Ci}$ increases while that of $F_{Cj}$ decreases. Conversely, the magnitude of the projection's vertical force component $F_{Bj}$ is generally greater than that of the horizontal force component $F_{Bi}$. As the angle α approaches a point perpendicular to the ground engaging surface of the shoe, the magnitude of $F_{Bj}$ increases while that of $F_{Bi}$ decreases.

Both forces $F_C$ and $F_B$ generally act to oppose reaction force $F_F$ as it acts against the closure panel 10. The vertical force components $F_{Bj}$ and $F_{Cj}$ act to counter the vertical force component $F_{Fj}$. These forces act along both the RS segment of RST and the ST segment. As the RS segment approaches an angular orientation perpendicular to the ground engaging surface, the vertical forces upon it decrease, while the horizontal forces remain constant. Similarly, the horizontal force components $F_{Bi}$ acts to counter the horizontal force components $F_{Fi}$ and $F_{Ci}$. In the horizontal orientation, forces acting on the RS segment of RST increase as the RS segment approaches an angular orientation perpendicular to the ground engaging surface, but forces are not applied to the ST segment, as it is parallel to the direction of the forces. As $F_B$ approaches a vertical angular orientation with the ground engaging surface, its effect on the overall horizontal force calculation decreases.

FIG. 10B depicts the vertical force components $F_{Bj}$ and $F_{Cj}$ that oppose the vertical force component $F_{Fj}$. While the vertical components $F_{Bj}$ and $F_{Cj}$ are depicted at single points in FIG. 10A, they actually produce a continuum of force along the entire closure panel 10 (line RST). Such forces decrease as a distance from the actual directed force increases, as depicted by the polygonal shapes formed by the plurality of force arrows in FIG. 10B. As the forces generated by $F_{Bj}$ and $F_{Cj}$ approach termination points R and T of RST, the forces reduce and may ultimately terminate depending on such factors as the magnitude of the force and rigidity of the RST. The area between the two vertical force components benefits by a more even distribution of force along its entire length. This more even distribution is the result of the combination of $F_{Bj}$ and $F_{Cj}$ and is at its minimum magnitude at a distance d from $F_{Bj}$. Distance d will vary based on such factors as the magnitude of the vertical force components and the rigidity of RST. Thus, a more even distribution of force along a greater length of the foot is possible by using both the cable 40 and anchored front projections 11 of the present invention.

FIG. 10C depicts the horizontal force components $F_{Bi}$ and $F_{Ci}$. Horizontal force component $F_{Fi}$ is not shown in this figure. While the horizontal components $F_{Bi}$ and $F_{Ci}$ are depicted at single points in FIG. 10A, they actually produce a continuum of force along the entire closure panel 10 (line RST), specifically between points R and S. These forces decrease in magnitude in a manner similar to that described above as the distance from the applied force increases. As can be seen, a more even distribution of force occurs along the RS portion of RST. Also, the $F_{Bi}$ force opposing the more substantial $F_{Ci}$ force may be decreased based on such factors as magnitude of the horizontal force component $F_{Ci}$ and rigidity of RST. Thus, even with an opposing force $F_{Ci}$ caused by the anchored front projection 11, the cable system of the present invention produces a more even distribution of force along a greater length of the foot/ankle. In the present invention, a decrease in angle θ of $F_C$ can increase the horizontal restraining forces of the shoe without sacrificing all the vertical restraining forces, as those are constantly provided by $F_B$.

As can be seen in FIGS. 10A–10C, a shoe closure system in accordance with the invention has many advantages. For example, by anchoring the front projections 11 of the closure panel 10, an increase in force on the cable 40 does not cause the closure panel 10 to ride up on or overcompress the sensitive instep region. Because the cable 40 is disposed at an acute angle (in particular, less than about 45 degrees) relative to the ground engaging surface of the shoe, the force is applied to the closure panel 10 primarily horizontally and secondarily vertically. The smaller the angle θ, the greater the horizontal force is relative to the vertical force, which improves the seating of the foot in the heel area of the shoe, without excessive loading of the foot against the sole.

The positioning of the cable 40 at an acute angle of less than about 45 degrees provides more comfort and better fit/retention of the shoe on the foot with a lowered or tailored force profile. The angle of the cable 40 relative to the ground engaging surface can vary to suit a particular application or accommodate various foot sizes, for example, the cable 40 can be disposed from about 20 degrees to about 35 degrees relative to the ground engaging surface, preferably from about 25 degrees to about 30 degrees, and more preferably about 27 degrees.

Generally, the various components of the shoe closure systems described herein can be manufactured by, for example, injection molding or extrusion and optionally a combination of subsequent machining operations. Extrusion processes may be used to provide a uniform shape, such as a single monolithic frame. Insert molding can then be used to provide the desired geometry of the open spaces, or the open spaces could be created in the desired locations by a subsequent machining operation. Other manufacturing techniques include melting or bonding additional portions. In addition to adhesive bonding, components can be solvent bonded, which entails using a solvent to facilitate fusing of various components.

The various components can be manufactured from any suitable polymeric material or combination of polymeric materials, either with or without reinforcement. Suitable materials include: polyurethanes, such as a thermoplastic polyurethane (TPU); ethylene vinyl acetate (EVA); thermoplastic polyether block amides, such as the Pebax® brand sold by Elf Atochem; thermoplastic polyester elastomers, such as the Hytrel® brand sold by DuPont; thermoplastic elastomers, such as the Santoprene® brand sold by Advanced Elastomer Systems, L.P.; thermoplastic olefin; nylons, such as nylon 12, which may include 10 to 30 percent or more glass fiber reinforcement; silicones; polyethylenes; acetal; and equivalent materials. Reinforcement, if used, may be by inclusion of glass or carbon graphite fibers or para-aramid fibers, such as the Kevlar® brand sold by DuPont, or other similar method. Also, the polymeric materials may be used in combination with other materials, for example rubber. Other suitable materials will be apparent to those skilled in the art.

In a particular embodiment, the closure panel 10 can be manufactured from a combination of two different materials, such as a laminated plastic material, for example Pebax layered on a nylon fabric. This material arrangement creates stability when contact pressure is applied on the upper 1, while avoiding the creation of localized pressure points on the sensitive instep area of the foot. In other embodiments, the use of other materials, such as leather, is also possible, as is a layer of foam on the side of the closure panel 10 directed against the upper 1 for improved wearing comfort. In another embodiment, the closure panel 10 and/or other parts of the upper 1 may be covered by an additional layer of material.

In one embodiment, the lever mechanism 50 and the recess 4 at the heel 3 are preferably made from highly stable materials that can permanently resist high mechanical loads. In one embodiment, the recess 4 is made from a plastic material formed by injection molding. Light metals such as aluminum can be die cast into a desired shape and used for the components of the lever 52. Small parts, which are subject to large loads, such as the pin 51 or the adjustment screw 54 can be made from a stronger material, such as steel or stainless steel. Additionally, the slide 53, as well as the recess in which it slides, may be coated with a friction-reducing material, for example Teflon®, to allow a particularly easy adjustment. The cable 40 may be stranded stainless steel, a composite, or other high strength, corrosion resistant material.

In addition, the receiving element 90 can be manufactured from two materials, similar to the closure panel 10. In one embodiment, the receiving element 90 is manufactured from a soft polyurethane and a more rigid polyurethane. This combination of materials provides sufficient stability while avoiding a localized pressure on the foot through the upper 1.

Having described certain embodiments of the invention, it will be apparent to those of ordinary skill in the art that other embodiments incorporating the concepts disclosed herein may be used without departing from the spirit and scope of the invention. The described embodiments are to be considered in all respects as only illustrative and not restrictive.

What is claimed is:

1. A shoe comprising:

a flexible upper for receiving a foot;

a closure panel arranged at an instep area of the flexible upper; and a tightening element coupled to the closure panel and arranged at a heel region of the shoe, the tightening element operatively retaining the shoe on the foot by biasing the closure panel against the instep area, wherein the closure panel three-dimensionally encompasses the instep area of the upper and comprises a foam layer on a side proximate the upper.

2. The shoe of claim 1, wherein the closure panel comprises a flexible material.

3. The shoe of claim 2, wherein the closure panel is adapted to conform flexibly to the instep area of the upper.

4. The shoe of claim 1, wherein the closure panel is disposed on an exterior of the upper.

5. The shoe of claim 1, wherein the closure panel is fixedly anchored to at least one of the lower forefoot portion of the upper and the sole of the shoe.

6. The shoe of claim 1, wherein the closure panel comprises a side region extending to at least one of a lateral rear side and a medial rear side of the shoe for connecting the closure panel to the tightening element.

7. The shoe of claim 6, further comprising at least one of a lateral receiving element and a medial receiving element, wherein a portion of the closure panel is slidable within the receiving element when the tightening element is operated to bias the closure panel against the instep area of the upper.

8. The shoe of claim 7, wherein the receiving element encompasses a rear portion of the upper from below the upper.

9. The shoe of claim 1, wherein the closure panel comprises a side region projecting to at least one of a lateral front side and a medial front side of the shoe, the side region of the closure panel attached to at least one of a lower forefoot portion of the upper and a sole of the shoe.

10. The shoe of claim 1, wherein the closure panel defines a ventilation opening.

11. The shoe of claim 1, wherein the tightening element is connected to the closure panel by a pulling element to transmit a force to the closure panel.

12. The shoe of claim 11, wherein the pulling element comprises at least one sheathed cable extending from the tightening element to the closure panel.

13. The shoe of claim 12, wherein the cable extends on both a lateral side of the shoe and on a medial side of the shoe from the tightening element to the closure panel.

14. The shoe of claim 12, wherein the cable extends at least partially below an insole of the shoe.

15. The shoe of claim 11, wherein the pulling element is securable to the closure panel at, at least two different locations.

16. The shoe of claim 1, wherein the tightening element comprises a lever mechanism.

17. The shoe of claim 16, wherein the lever mechanism comprises a pivotable lever couplable to a pulling element.

18. The shoe of claim 17, wherein the lever is attached releasably to the heel region.

19. The shoe of claim 18, wherein the lever comprises an axis and the heel region comprises a plurality of receptacles into which the axis of lever can be releasably received.

20. The shoe of claim 18, wherein the heel region comprises a plurality of upwardly directed projections defining grooves adapted for releasably receiving the lever.

21. The shoe of claim 17, wherein the pulling element is coupled to the lever via an adjustment mechanism to adjust a force applied to the pulling element caused by pivoting the lever.

22. The shoe of claim 21, wherein the adjustment mechanism comprises:

a slide moveable along the lever for receiving the pulling element; and an adjustment screw attached to the lever, wherein operation of the adjustment screw causes a movement of the slide along the lever.

23. The shoe of claim 22, wherein the adjustment screw is arranged so as to be adjustable independently of a position of the lever.

24. The shoe of claim 23, wherein an operating head for rotating the adjustment screw is arranged at an end of the lever remote from a pivot.

25. The shoe of claim 24, wherein the heel defines a recess for at least partially receiving the lever mechanism.

26. The shoe of claim 25, wherein the lever is securable in the recess in an upwardly pivoted position.

27. The shoe of claim 26, wherein at least one of the lever and the recess comprise structure to retain the lever in the recess of the shoe.

* * * * *